United States Patent [19]

Mikola

[11] Patent Number: 4,500,946

[45] Date of Patent: Feb. 19, 1985

[54] REPLACEABLE LAMP ASSEMBLY FOR A SEALABLE REFLECTOR HOUSING

[75] Inventor: James A. Mikola, Livonia, Mich.

[73] Assignee: Ford Motor Company, Dearborn, Mich.

[21] Appl. No.: 339,194

[22] Filed: Jan. 13, 1982

[51] Int. Cl.[3] ..... H01R 33/00

[52] U.S. Cl. ..... 362/226; 362/267; 339/186 R

[58] Field of Search ..... 313/318; 339/184 L, 339/184 M, 186 R, 186 M, 186 T; 362/226, 267

[56] References Cited

U.S. PATENT DOCUMENTS

| | | | |
|---|---|---|---|
| 2,466,566 | 4/1949 | Tiscione | 339/184 L X |
| 3,077,571 | 2/1963 | Curtis et al. | 339/186 M X |
| 3,185,954 | 5/1965 | Schade, Sr. | 339/186 T X |
| 3,588,337 | 6/1971 | Okleshen | 339/184 L X |
| 3,614,711 | 10/1971 | Anderson et al. | 339/186 M X |
| 3,691,508 | 9/1972 | Morse | 339/186 T X |
| 3,732,415 | 5/1973 | Lindae | 362/226 |
| 3,818,215 | 6/1974 | Schmidt et al. | 362/226 |
| 3,848,120 | 11/1974 | Wolfe et al. | 313/318 X |
| 4,075,531 | 2/1978 | Marino | 313/318 X |
| 4,276,583 | 6/1981 | Fratty | 362/214 |
| 4,276,585 | 6/1981 | Deverrewaere | 362/308 |
| 4,362,166 | 7/1982 | Furler et al. | 339/186 R X |
| 4,376,967 | 3/1983 | Hough | 362/226 X |
| 4,385,257 | 5/1983 | Fitzgerald | 362/226 X |
| 4,412,273 | 10/1983 | Helbig et al. | 362/211 |

FOREIGN PATENT DOCUMENTS

| | | | |
|---|---|---|---|
| 2144768 | 3/1973 | Fed. Rep. of Germany | 339/186 M |
| 2327119 | 5/1973 | Fed. Rep. of Germany | 362/226 |
| 2346549 | 3/1975 | Fed. Rep. of Germany | 362/226 |
| 3002563 | 7/1981 | Fed. Rep. of Germany | 339/186 M |
| 2370230 | 6/1978 | France . | |
| 2442399 | 6/1980 | France . | |
| 164641 | 10/1956 | Sweden | 362/226 |
| 597560 | 1/1948 | United Kingdom | 339/186 T |

OTHER PUBLICATIONS

Bombara et al., *Keying Device*, IBM Tech. Disc. Bull., vol. 21, #2, 7-1978, pp. 519-521.

*Primary Examiner*—Peter A. Nelson

*Attorney, Agent, or Firm*—Paul Godwin, Jr.

[57] ABSTRACT

A reusable lens/reflector unit is formed to accept a molded plastic replaceable lamp plug assembly formed to provide a hermetic seal for the lens/reflector unit. Internal sealing of electrodes within the lamp plug assembly provides electrical interconnection and mechanical support for the lamp bulb in a predetermined position. Coding means provides that only designated lamp plug assemblies may be mated with appropriate lens/reflector units.

11 Claims, 3 Drawing Figures

REPLACEABLE LAMP ASSEMBLY FOR A SEALABLE REFLECTOR HOUSING

BACKGROUND OF THE INVENTION

1. Field of the Invention

The present invention is directed to the field of high intensity lighting devices and more particularly to the area of lamp plug assemblies that are removably inserted into a sealable and reusable reflector housings.

2. Description of the Prior Art

Conventional sealed beam headlamps, as utilized in U.S. manufactured automobiles, typically utilize a tungsten filament embedded in a molded glass reflector portion. The reflector portion is fuzed to a diffusion lens component. The resultant enclosure is evacuated and permanently sealed. In the event of a lens crack or filament failure, the entire sealed beam unit, including the reflector, lens and filament must be replaced. In order to keep replacement prices within reason, sealed beam headlamps are government regulated and consequently supplied to the market in a very few standard sizes and shapes. Accordingly, automotive styling, in the area of headlamps, is severly restricted, from an aerodynamic standpoint, due to the necessity of utilizing these standard sealed beam units.

Some European vehicles have, in the past, utilized stylized removable lenses with reflectors and replaceable lamps for headlamp units. However, due to the fact that the lenses were generally removable from the body moldings, dirt and moisture eventually was able to enter the interior of the unit and degrade the amount of light reflected out.

Some halogen lamps, currently on the market, are of a hermetically sealed variety in which a lens is sealed to a reflector. The reflector contains a rear opening for accepting a quartz halogen filament bulb, but a glass balloon is integrally formed onto the reflector so as to provide a transparent interface between the halogen bulb and the sealed reflector lens enclosure. The interior of the sealed enclosure is generally filled with a helium atmosphere to compensate for pressure changes, due to heat from the filament bulb. The problems which occur in these commercially available halogen lamps is due to the fact that dirt and moisture tends to enter the rear opening of the reflector between the quartz halogen filament bulb and the glass balloon. Therefore, over time, the radiation from this type of lamp will deteriorate until the bulb is removed and both the bulb and balloon are cleaned.

SUMMARY OF THE INVENTION

The present invention is intended to overcome the disadvantages encountered with prior art high intensity lamps by providing a replaceable lamp assembly for insertion into a uniquely formed reflector and lens assembly, while maintaining the interior of the assembly in a hermetically sealed condition. The present invention includes a filament lamp light source, such as a quartz halogen filament lamp permanently attached to rigid supporting means in a molded plug. The reflector and lens assembly are sealed together so that the only access to the external environment is through a rear socket on the reflector. The reflector and socket are integrally formed of a plastic material having an appropriately high melting temperature to allow compatability with the high temperatures produced by the quartz halogen lamp.

The body of the plug and the internal surface of the socket are precisely formed so as to allow insertion of the plug therein. In addition, the plug contains an elastomer material that, upon insertion into the socket, provides a hermetic seal to the reflector lens enclosure.

The replaceable lamp assembly further includes a locking means which surrounds the plug and socket to provide a positive connection between the two.

Since it is intended by the present invention to provide a standard by which identically sized parts may be used interchangeably, it is important that the plugs contain coding means so that the specific type of lamp attached thereto will only fit into a corresponding reflector. In some instances, the reflector units will be formed to utilize only a single filament lamp, wherein the filament is horizontally oriented and located at a predetermined spacial point within the reflector enclosure. Such a reflector unit may be different from another stylized enclosure where that reflector is intended to accept a dual filament lamp wherein the filaments must be displaced within the lamp by a predetermined amount and must be properly positioned within the reflector enclosure. A coding means is included in the present invention to insure that only properly corresponding plugs are insertable into each reflector socket. Those, which do not properly correspond, cannot be inserted far enough to establish a hermetic seal or enage the locking means. The coding means also insures proper orientation of the filaments as the plug is inserted into its properly corresponding socket.

It is, therefore, an object of the present invention to provide a replaceable lamp assembly that is matable with a hermetically sealable reflector-lens enclosure and, when inserted into the enclosure, provides a hermetic seal thereto.

It is another object of the present invention to provide a replaceable lamp assembly which is formed of a high temperature injection molded thermoplastic material that is accurately reproducible at relatively low cost.

It is a further object of the present invention to provide a replaceable lamp assembly for headlamps usage that allows for independent aerodynamic styling of the reflector/lens assemblies while at the same time providing a sealed light source that is impervious to dirt and moisture contamination.

DETAILED DESCRIPTION OF THE PREFERRED EMBODIMENT

Figure 1:
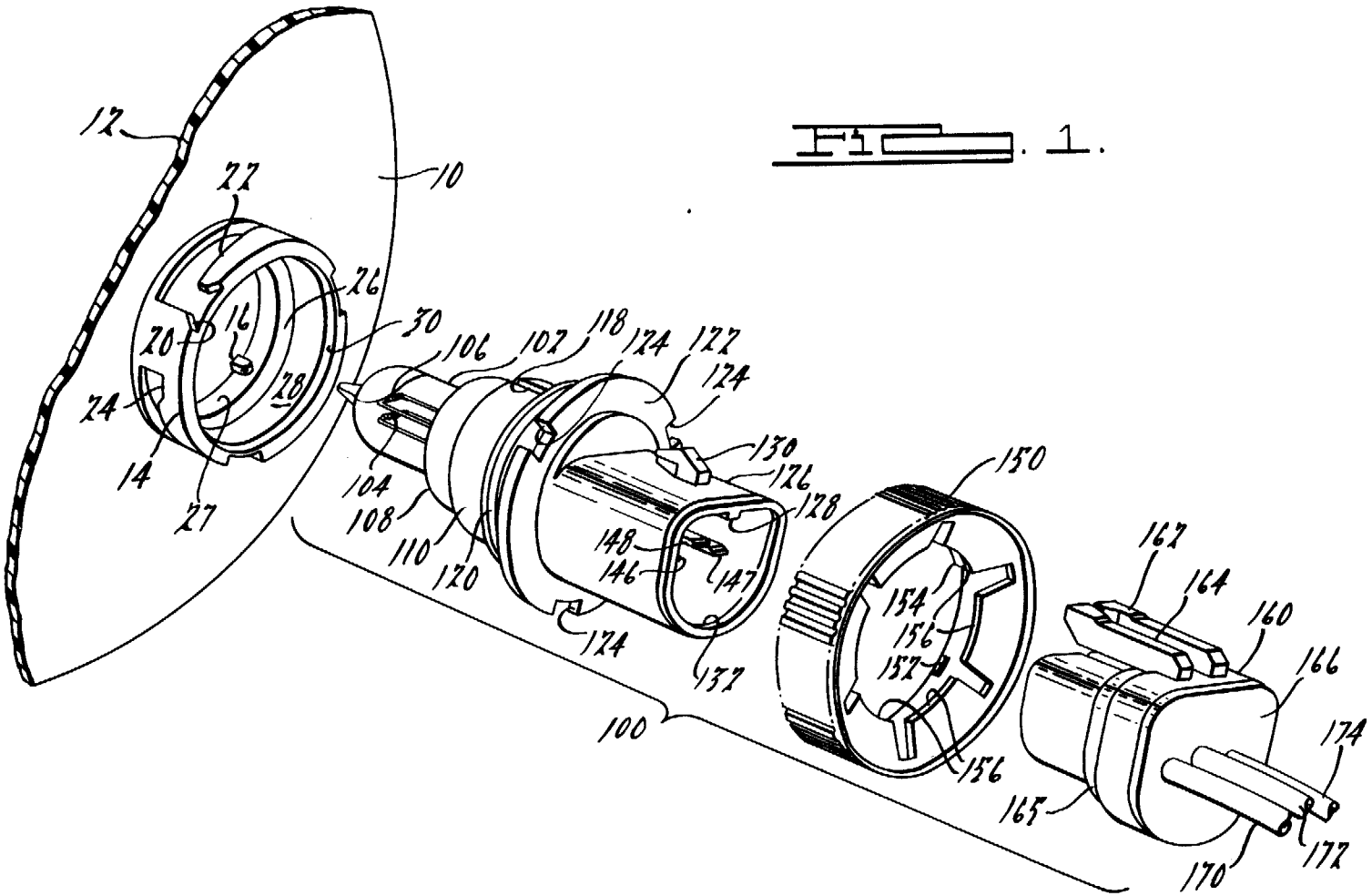
FIG. 1 is an exploded view of the present invention in association with a corresponding light reflector enclosure.
Figure 2:
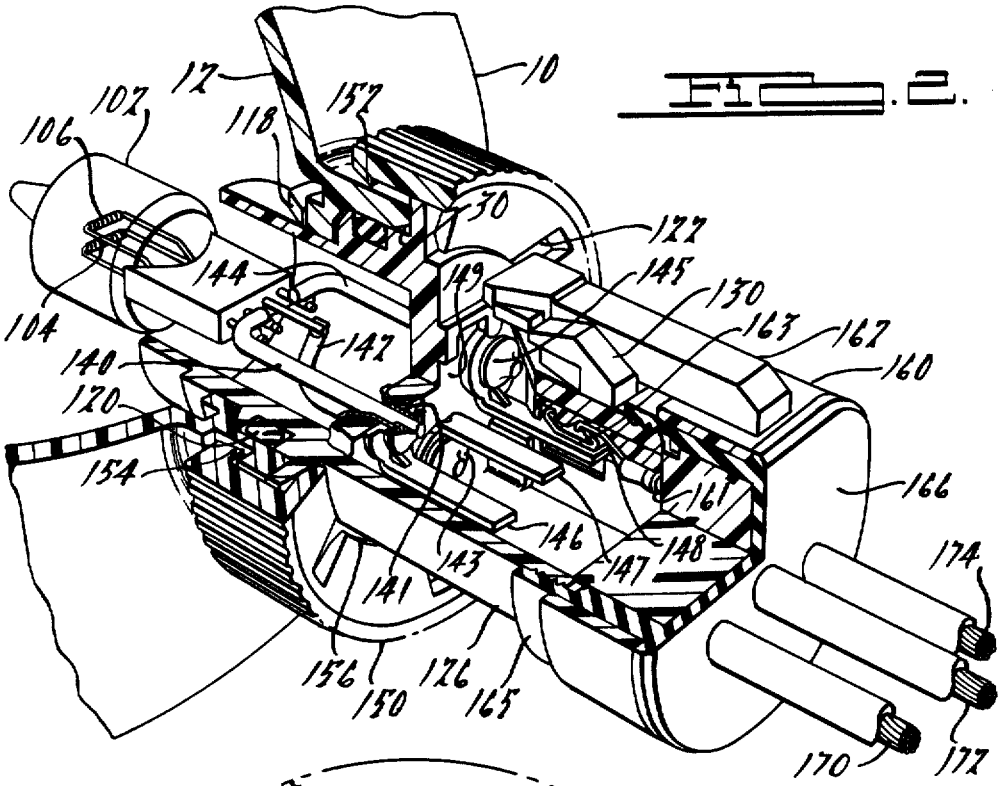
FIG. 2 is a partial cross-section of an assembled unit of the present invention mated in the socket of the reflector enclosure.
Figure 3:
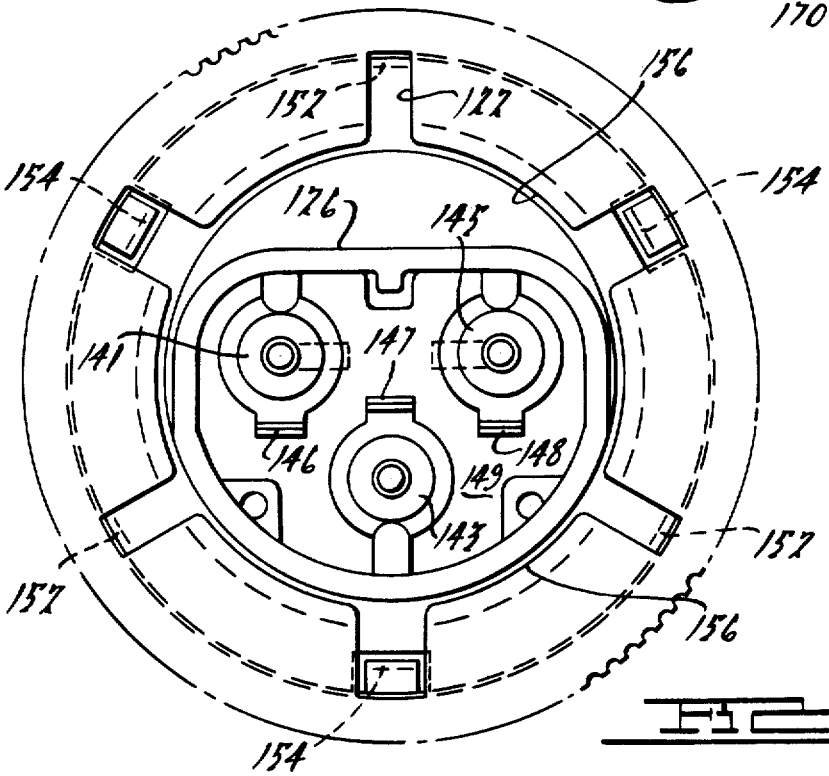
FIG. 3 is an end view of the present invention illustrating the electrical terminals and locking means.

The following description concurrently refers to FIGS. 1, 2 and 3, since they show various perspectives of the present invention.

A light reflector enclosure 10 is shown that includes a rear reflector element 12 and a lens (not shown). The light reflector enclosure 10 is intended to be a hermetically sealable enclosure, wherein the lens element is permanently sealed and affixed to the reflector element 12. The reflector and lens are not intended to be replaced whenever a filament of the lamp fails and therefore, may be formed in a unique manner for each vehicle model and still take advantage of standardized replacement lamps. The reflector element 12 includes a single cylindrical socket 14 extending from the rear of the reflector and having cylindrical interior surfaces 26, 27, 28 and 30 for receiving the replaceable lamp assembly of the present invention. The socket 14 extends outward from the reflector 12 and is axially aligned with a predetermined spacial point within the reflector. Several thread paths are circumferentially formed on the outer surface of the socket 14. Each of the threaded paths includes an open end 20, a camming path 22 and a closed end 24, containing a reverse angle camming surface to retain a path following element threaded therein. The interior portion of the cylindrical socket 14 includes an annular tapered guiding surface 30 extending from the outer edge of the socket 14 to an cylindrical sealing surface 28. An annular transition surface 26 is slightly sloped towards the reflector 12 from the sealing surface 28 and terminates at a smaller diameter lateral alignment surface 27 containing keys 16 which are part of the coding means feature.

The assembly 100 includes a lamp plug body assembly 110, a locking collar 150 and an electrical supply connector 160. The lamp plug body 110 is, of course, formed to mate with the socket 14 provided in the light enclosure 10.

A lamp 102 is shown support mounted in the plug body 110 and contains, in this case, a pair of displaced filaments 104 and 106 that are separately electrically energized. The filament leads extend through the base of the lamp 102 and are spot welded to electrically conductive support rods 140, 142 and 144. The support rods 140, 142 and 144 are disposed in a tripod arrangement and the opposite ends of those rods are secured to an integral base 149 of the plug via soldering to hermetically sealed eyelets 141, 143 and 145, respectively. As part of the assembly for supporting the rods 140, 142 and 144, electrical male blade terminals 146, 147 and 148 are riveted in place under the eyelets 141, 143 and 145 on the external side of the base 149 prior to soldering the rods in place. While it is expected that the three support rods will be sufficient to retain the lamp in a predetermined location with respect to the plug body 110, it may, in some cases, be necessary to encapsulate the rods for added rigidity.

The plug body 110 includes a shroud 108 that surrounds the support rods and the base of the lamp 102 to prevent misalignment of the filaments in the bulb with respect to the plug during handling or assembly. Aft of the shroud 108, the plug body 110 includes a set of keyways 118 which are circumferentially disposed about the plug to correspond in location to the keys 16 within the socket 14. Although it cannot be seen in the figures, this embodiment includes a key 16 located at a "12 o'clock" position within the socket 14 to mate with the keyway 118 shown in the figures. The key 16 is at the "12 o'clock" position within the socket 14 and the keyway 118 are of a close tolerance so that when the plug body 110 is inserted in the socket 14 the key 16 will dictate the precise angular orientation (horizontal) of the filaments 104 and 106 with a high degree of accuracy to their specified spacial location point within the light enclosure 10. Other keys 16 in the socket 14 also find corresponding keyways 118 on the plug body 110 so that only a properly corresponding plug and filament lamp may be inserted into this particular lens/reflector enclosure 10. For instance, keys at "4 o'clock" and "7 o'clock" positions represent a particular dual filament lamp of a particular length used in the pictured embodiment.

An elastomer "O" ring 120 is provided in a channel on the plug body 110 spaced aft of the keyways 118 to provide a hermetic seal only when the plug is fully mated into the socket 14.

A flange 122 is formed on the plug body 110, aft of the elastomer "O" ring 120 and has a diametric measurement exceeding that of the annular socket 14 so as to limit the maximum distance of insertion of the lamp filaments to the correct focal depth in the socket 14. The flange contains a plurality of notched passages 124 that correspond to the location of the openings 20 of each of the thread paths on the socket 14.

A knurled locking collar 150 contains a plurality of thread path follower elements 154, disposed about the leading edge of the internal surface thereof so as to pass through the passages 124 and the thread path openings 20, when the plug body 110 is inserted in the socket 14. The locking collar 150 is formed so as to surround the plug body 110, the flange 122 and the socket 14 when those elements are mated. The locking collar 150 contains several cantilevered compression tabs 156 on its aft end that force the flange 122 tight against the socket 14 when the collar is fully threaded thereon. The locking collar 150 further includes several ratchet shaped retainer elements 152 disposed about the leading edge of the internal surface thereof so as to provide a mechanism by which to catch the flange 122 when it is desired to pull it outwardly from the socket 14. This is a disassembly feature, used to withdraw the plug from the socket 14 while retaining a hold on the locking collar 150. The retainer elements 152 extend over the edge of the flange 122 but not sufficiently enough to contact the outer surface of the socket 14.

The lamp plug body 110 further includes a "D" shaped plug connector shroud 126 that extends from the flange area backward over the electrical male blade terminals 146, 147 and 148 to define a receptive opening 132. A locking prow 130 is located on the flat surface of the "D" shaped shroud 126 to provide a portion of a locking mechanism for electrical plug 160. A key 128 is located on the inside of the flat surface of the "D" shaped shroud 126 to provide an alignment guide for electrical plug 160 as it is inserted through receptive opening 132 in connector shroud 126.

The electrical plug 160 is interconnected to supply wires 170, 172 and 174, which extend through an elastomer sealing material 166. The elastomer seal 166 extends forward so as to provide a sealing skirt 165 that will provide an environmental seal to the electrical connection within the shroud 126. The plug 160 also contains several conventional compression type female box terminals 161 which provide electrical mating with electrical male blade terminals 146, 147 and 148. The upper portion of the plug 160 contains two cantilevered locking levers 162 and 164 which are constructed in a manner that is described in commonly assigned U.S. Pat. No. 4,273,403 and interact with the prow 130 to provide a lock/disconnect mechanism.

While it is apparent that many modifications and variations may be implemented without departing from the scope of the novel concept of this invention, it is intended by the appended claims to cover all such modifications and variations which fall within the true spirit and scope of the invention.

I claim:

1. A replaceable lamp plug assembly for mating with a hermetically sealable lamp enclosure including a light transmitting lens, attached to the front of a light directing reflector and an open cylindrical socket formed to extend outwardly from the rear of said reflector comprising:

a filament lamp light source; and plug means having a body portion formed to be axially inserted into said cylindrical socket wherein said plug means includes means for permanently supporting said lamp so that the filament of said lamp is located at a predetermined point and in a predetermined orientation with respect to said body portion; means for hermetically sealing said lamp enclosure when said plug means is inserted into the rear of said cylindrical socket; a base flange extending transverse to said body portion and having a diametric dimension larger than that of said cylindrical socket for contacting the outward extension of said cylindrical socket and limiting the insertion distance of said plug means into said socket; a plurality of electrical terminals permanently connected through said body portion to said filament of said lamp; and a plug connector shroud on the opposite end of said plug means from said support means, extending beyond said base flange and surrounding said terminals.

2. An assembly as in claim 1, wherein said support means comprises a plurality of rigid electrical conductors electrically connected to filament leads extending through the base of said lamp and rigidly mounted within said body portion to locate said filament at said predetermined point and said electrical conductors are permanently connected to said conductors.

3. An assembly, as in claim 2, wherein said reflector is formed to present a predetermined light radiation pattern, when the filament of said lamp is located and oriented at a predetermined spacial point within said enclosure, and said cylindrical socket is coaxially aligned with said predetermined spacial point.

4. An assembly as in claim 3, further including coding means for allowing only properly corresponding plug means to be mated with said cylindrical socket.

5. An assembly as in claim 4, wherein said coding means comprises a plurality of spacially disposed keys and keyways on the respective interior surface of said cylindrical socket and the external surface of said body portion and further wherein said spacial disposition dictates correct plug and socket correspondence as well as the correct orientation of said filament.

6. An assembly as in claim 5, wherein said sealing means includes an elastomer ring surrounding and retained on said body portion of said plug means between said coding means and said base flange.

7. An assembly as in claim 6, wherein said outer surface of said body portion of said plug means between said coding means and said base flange contains a circumferential channel for retaining said elastomer ring.

8. A replaceable lamp plug assembly for insertion into a cylindrical socket extending from the rear of a focused reflector enclosure comprising:

an encapsulated filament lamp;

plug means for supporting said filament lamp in a predetermined position;

means on said plug means for providing a hermetic seal between the interior surface of said cylindrical socket opening and said plug means when said plug means is inserted into the rear of said cylindrical socket;

coding means for allowing the insertion of a correctly corresponding filament lamp of said assembly into said socket opening and precisely locating its filament with respect to a predetermined piont in said enclosure;

a plurality of electrical terminals permanently connected to the filament of said filament lamp and extending through said plug means; and a terminal shroud on the opposite end of said plug means from said support means extending away from said filament lamp and surrounding said terminals.

9. A replaceable lamp plug assembly, as in claim 8, wherein said coding means includes a set of protruding key elements formed on the interior surface of said cylindrical socket in a spaced arrangement and a like set of keyways formed on the outer surface of said plug means for a correctly corresponding filament lamp.

10. A replaceable lamp plug assembly, as in claim 9, wherein said filament lamp has rigid filament leads extending therefrom and said leads are precisely welded to electrically conducting support rods within said plug means to support said filament lamp in a predetermined orientation within said assembly.

11. A replaceable lamp plug assembly, as in claim 10, wherein said electrical terminals are male blade terminals connected to said support rods and said plug connector shroud extends beyond said blade terminals to form a receptive opening.

* * * * *